US009314798B2

(12) United States Patent
Sangameswaran et al.

(10) Patent No.: US 9,314,798 B2
(45) Date of Patent: Apr. 19, 2016

(54) SIEVE PROFILE OF A RICE POLISHING MACHINE

(75) Inventors: Gopalakrishnan Trikkur Sangameswaran, Attibele (IN); Srikanth Dinamani Rao, Attibele (IN)

(73) Assignee: Buhler (India) PVT. LTD., Attibele, Bangalore District (IN)

( * ) Notice: Subject to any disclaimer, the term of this patent is extended or adjusted under 35 U.S.C. 154(b) by 308 days.

(21) Appl. No.: 13/824,836

(22) PCT Filed: Jan. 12, 2012

(86) PCT No.: PCT/IN2012/000034

§ 371 (c)(1), (2), (4) Date: Mar. 18, 2013

(87) PCT Pub. No.: WO2012/107935

PCT Pub. Date: Aug. 16, 2012

(65) Prior Publication Data

US 2013/0183425 A1 Jul. 18, 2013

(30) Foreign Application Priority Data

Feb. 7, 2011 (IN) ..... 338/CHE/2011

(51) Int. Cl.
*B02B 3/00* (2006.01)
*B02B 3/04* (2006.01)

(52) U.S. Cl.
CPC ... *B02B 3/00* (2013.01); *B02B 3/04* (2013.01); *Y10T 29/49* (2015.01); *Y10T 29/49817* (2015.01)

(58) Field of Classification Search
CPC ..... B02B 3/00; B02B 3/04; Y10T 29/49; Y10T 29/49817
USPC ..... 99/519, 610, 524, 528, 601, 605, 611, 99/618; 241/73, 239; 426/483
See application file for complete search history.

(56) References Cited

U.S. PATENT DOCUMENTS

| | | | | |
|---|---|---|---|---|
| 4,323,006 | A * | 4/1982 | Satake | 99/519 |
| 4,426,922 | A * | 1/1984 | Yamamoto | 99/519 |
| 4,829,893 | A * | 5/1989 | Satake | 99/603 |

FOREIGN PATENT DOCUMENTS

| | | | |
|---|---|---|---|
| CN | 2928231 | Y | 8/2007 |
| DE | G 8807 867.1 | U | 9/1988 |
| DE | 10 2006 029286 | A | 1/2007 |

(Continued)

OTHER PUBLICATIONS

PCT/IN2012/000034, Search Report, Aug. 7, 2013.*

(Continued)

*Primary Examiner* — Jianying Atkisson
(74) *Attorney, Agent, or Firm* — Frommer Lawrence & Haug LLP

(57) ABSTRACT

The invention relates to a rice-polishing machine sieve profile. In one embodiment this is accomplished by an elongate, tubular shaped sieve arrangement with a polygonal profile, comprising a cam essentially cylindrical shape co-axially arranged" within the sieve arrangement such that between an inner surface of the sieve arrangement and a jacket-surface of the cam a polishing chamber has a maximal and a minimal radial distance between jacket-surface of the cam and the inner surface of the sieve arrangement, characterized in that the number of corners of the polygonal profile is larger than 8.

12 Claims, 4 Drawing Sheets

(56) References Cited

FOREIGN PATENT DOCUMENTS

| | | | |
|---|---|---|---|
| EP | 0 646 414 | A | 4/1995 |
| JP | 05-049954 | A | 3/1993 |

OTHER PUBLICATIONS

CN 2928231 Y, Bai et al. Derwent, Abstract, English Translation, Aug. 1, 2007.*

* cited by examiner

Prior Art

Prior Art

SIEVE PROFILE OF A RICE POLISHING MACHINE

This application is a 371 of PCT/IN2012/000034 filed on Jan. 12, 2012, published on Aug. 16, 2012 under publication number WO 2012/107935 A, which claims priority benefits to Indian Patent Application No. 338/CHE/2011 filed Feb. 7, 2011, the entire disclosure of which is incorporated herein by reference.

FIELD OF THE INVENTION

The invention generally relates to a rice-polishing machine. More particularly, embodiments of the invention relates to a sieve arrangement for a rice-polishing machine. The invention also relates to a method of polishing rice and a method of upgrading rice polishing machines.

BACKGROUND

Machines for polishing rice grains developed over the years include the friction type horizontal axis machines wherein the unpolished rice grains pass through a chamber from one end to another end. The chamber includes a cam roll surrounded on the periphery by a perforated screen, also referred to as a sieve. Normally, the sieve is configured to form a polygonal surface. Further, pluralities of tooth like projections on the outer surface of the cam. The cam with tooth like projections along with the sieve creates a gap in the rice polishing machine and restricts the passage of the grains during their movement along the axis of the rice polishing machine. Further, the gap of the passage varies between a maximum and a minimum thereby creating an annulus. The annulus so formed in the chamber provides a pressure gradient and this allows for effective polishing of rice grains.

FIG. 1 shows cross sectional view of a shaft assembly of an existing horizontal rice-polishing machine with a capacity of 4-5 tons per hour (tph), showing the relative arrangement between the cam, teeth and the sieve. The minimum gap between the cam and the sieve makes sure that rice grains are packed and pressure is sufficient to create friction between rice grains. The maximum gap between the cam and the sieve ensures that the rice grains are unpacked and allows for mixing and exchange of rice grains as it moves along the chamber. These actions take place repeatedly in the polishing chamber and helps in polishing of the rice grains.

However, when a polishing machine is designed for operating at higher loads, the maximum and the minimum gaps aforementioned, that exists between the cam and the sieve is severally altered, leading to improper polishing of the rice grains. This is predominantly due to the polygonal construction of the sieve which does not provide the required gap distance for ensuring effective polishing. Hence, there is a need for a construction of a sieve which allows for alignment of the gap to ensure effective polishing.

SUMMARY OF THE INVENTION

Accordingly, an aspect of the present invention is to provide a rice polishing machine with an elongate, tubular shaped sieve arrangement with a polygonal profile, comprising a cam essentially cylindrical shape co-axially arranged within the sieve arrangement such that between an inner surface of the sieve arrangement and a jacket-surface of the cam a polishing chamber has a maximal and a minimal radial distance between jacket-surface of the cam and the inner surface of the sieve arrangement, characterized in that the number of corners of the polygonal profile is larger than 8.

In another aspect of the present invention relates to a sieve arrangement, in particular for the rice polishing machine, having an elongate, tubular shape with a polygonal profile, characterized in that the number of corners of the polygonal profile is larger than 8.

In another aspect of the present invention relates to a method of upgrading a rice polishing machine, wherein a tubular sieve arrangement of the rice polishing machine is replaced by a tubular sieve arrangement with a polygonal profile with more than 8 corners.

In another aspect of the present invention relates to a method of upgrading a rice polishing machine, wherein a tubular sieve arrangement with a polygonal profile is modified in that the sides between corners of the polygonal profile are bent inwardly either by forming additional, concave corners or by forming concavely curved sides.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

So that the manner in which the above recited features of the present invention can be understood in detail, a more particular description of the invention, briefly summarized above, may be had by reference to various embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAIL DESCRIPTION OF THE INVENTION

Figure 1:
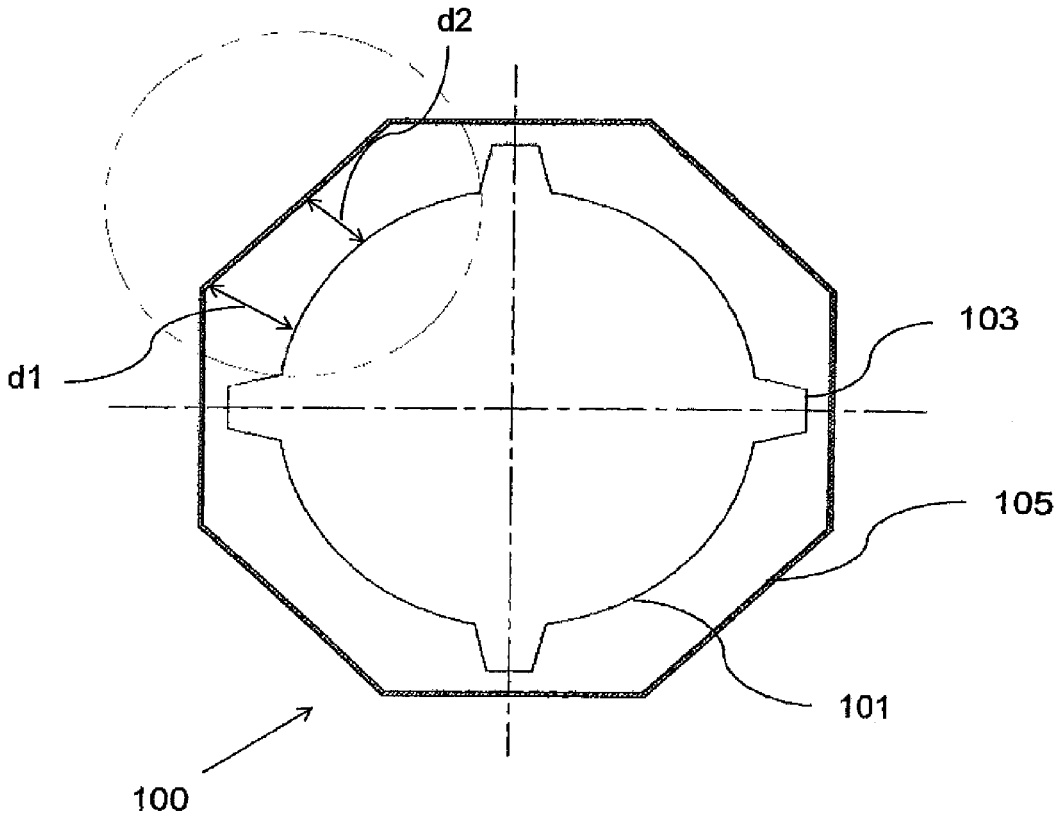
FIG. 1 is a cross section view of the polishing chamber of an existing polishing machine according to the prior art with a capacity of 4-6 tph, showing relative arrangement between the cam, teeth and the polygonal screen.

One aspect of the invention provides a rice polishing machine with an elongate, tubular shaped sieve arrangement with a polygonal profile, comprising a cam with an essentially cylindrical shape co-axially arranged within the sieve arrangement. The arrangement of sieve arrangement and cam are such that between an inner surface of the sieve arrangement and a jacket-surface of the cam a polishing chamber is formed, where the polishing chamber has a maximal and a minimal radial distance between jacket-surface of the cam and the inner surface of the sieve arrangement. According to the invention, the number of corners of the polygonal profile is larger than 8.

The essentially cylindrical shape of the cam does also include structures on the jacket-surface as e.g., protrusions, grooves or recesses. The minimal and maximal distance can in this case be calculates from the major part of the jacket surface with constant radius or, in the case of surface filling structures, from a mean radius.

A polygonal profile or structure in the preset context refers to a plane figure that is bounded by a closed path or circuit, composed of a finite sequence of line segments (i.e., by a closed polygonal chain). These segments are referred to as its "sides" and the points where two slides meet are the polygon's "corners". Herein, corners having an interior angle of less than 180° are called "convex corners" and corners with an interior angle larger than 180° are referred to as "concave corners". The polygonal profile of the sieve arrangement can therefore also have an e.g. 8-fold star-shape (i.e. star with 8 spikes) having 8 convex and 8 concave corners and thus, in total, 16 corners.

In a preferred embodiment of a rice polishing machine according to the invention, a ratio between the maximal and the minimal radial distance between jacket-surface of the cam and the inner surface of the sieve arrangement is between 1.2 and 1.5, independent of the absolute value of a radius of the cam, in particular between 1.3 and 1.4 and preferentially around 1.35.

In a further preferred embodiment of the invention, the number of corners of the polygonal profile is even.

In another embodiment of the invention, the polygonal profile comprises concave and convex corners.

In another preferred embodiment, each convex corner of the polygonal profile is neighboured by two concave corners such that an alternating sequence of convex and concave corners is formed.

Embodiments of the sieve arrangement, however, are not restricted to polygonal profiles with even numbers of corners or equal numbers of convex and concave corners. As the case may be, it could be considered advantageous to have e.g. only every third corner concave.

In another preferred embodiment, the sides of the polygonal profile between the corners are straight.

In a further embodiment of the invention, however, the sides of the polygonal profile between the corners are curved, in particular concavely curved.

The desired range for the minimal radial distance is 13 to 25 mm, in particular 17 to 23 mm. A value of around 22 mm has been proven to be particularly advantageous.

Another aspect of the invention provides a sieve arrangement, in particular for a rice polishing machine according to any one of the embodiments described herein, having an elongate, tubular shape with a polygonal profile, where the number of corners of the polygonal profile is larger than 8.

As described above, preferred embodiments of the sieve arrangement have concave and convex corners.

Preferentially, each convex corner of the polygonal profile is neighboured by two concave corners such that as alternating sequence of convex and concave corners is formed.

In another embodiment, the sides of the polygonal profile between the corners are straight or, alternatively, curved, in this case in particular concavely curved.

A further aspect of the invention provides a method of polishing rice where the rice is polished with a rice polishing machine according to the invention.

Another aspect of the invention provides a method of upgrading a rice polishing machine, wherein a tubular sieve arrangement of the rice polishing machine is replaced by a tubular sieve arrangement with a polygonal profile with more than 8 corners, in particular a sieve arrangement as described in the above.

In a preferred variation of the method for upgrading, the sieve arrangement is co-axially arranged around an essentially cylindrical cam of the rice polishing machine such that a ratio between a maximal and a minimal radial distance between an inner surface of the sieve arrangement and a jacket surface of the cam is between 1.2 and 1.5, in particular between 1.3 and 1.4, preferentially around 1.35.

In another variation of the method, the step of arranging the sieve arrangement around the cam involves choosing the sieve arrangement such that the minimal distance is in the range of 13 to 25 mm, in particular 17 to 23 mm, preferentially around 22 mm.

In another aspect of the invention, another method for upgrading a rice polishing machine comprises the steps of modifying a tubular sieve arrangement with a polygonal profile in that the sides between corners of the polygonal profile are bent inwardly either by forming additional, concave corners or by forming concavely curved sides.

In a preferred variation of the method, the sieve arrangement is modified such that a ration between a maximal and a minimal radial distance between an inner surface of the sieve arrangement and an essentially cylindrical cam co-axially arranged inside the sieve arrangement is between 1.2 and 1.5, in particular between 1.3 and 1.4, preferentially around 1.35.

In other words, the invention provides in one of its aspects a sieve arrangement for a rice-polishing machine. The sieve arrangement is configured to form a polygonal structure defining a maximum gap and a minimum gap between the sieve arrangement and the outer diameter of the cam. A ratio of the maximum gap to the minimum gap is predefined and is preferably in the range of 1.2 to 1.5.

An increase in the size of the polishing chamber alters the ratio. The ratio is restored by reconfiguring the surface of the sieve wherein within the polygonal structure of the sieve, an internal bend is provided for maintaining the ratio within the preferred range.

Figure 1A:
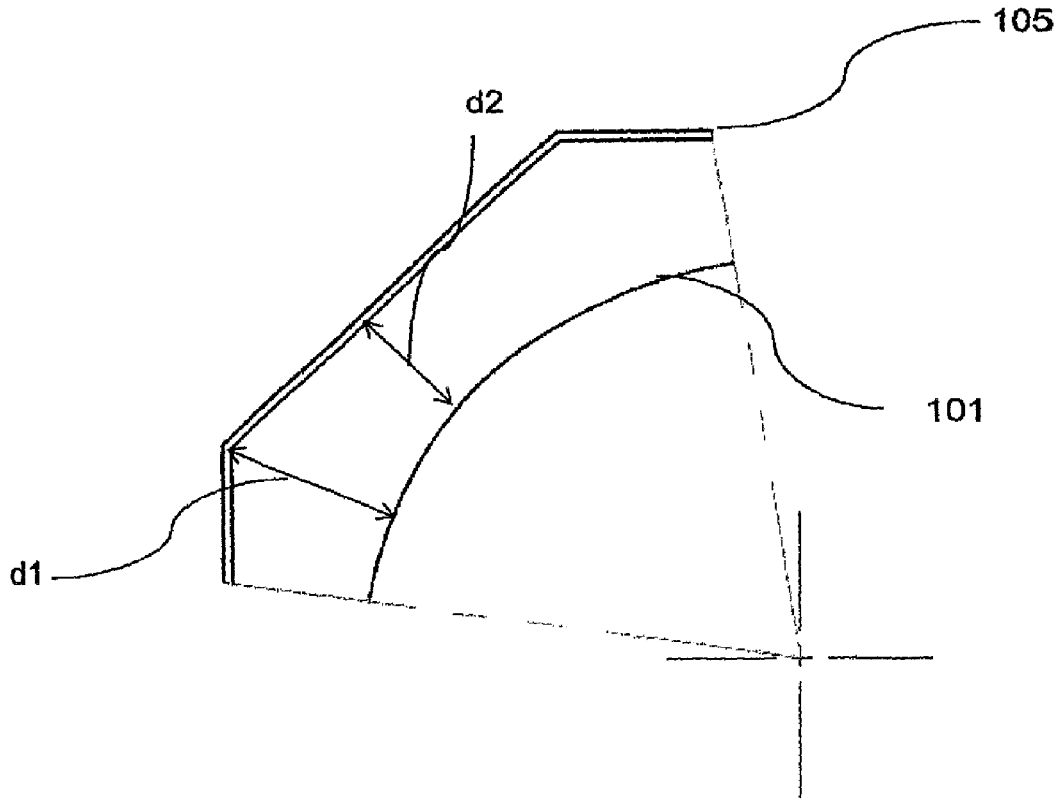
FIG. 1A shows an exploded section of a polishing chamber of FIG. 1, indicating the maximum and minimum gaps required for polishing.

Various embodiments of the invention provide a sieve arrangement for a rice-polishing machine. FIG. 1 is a cross section view of the polishing chamber 100 of a rice polishing machine (not shown) with a capacity of 4-5 tph. The polishing chamber 100 comprises of a cam 101 provided with a plurality of teeth 103. A sieve 105 surrounds concentrically to the cam 101. Further, the sieve 105 is configured to form a regular polygonal structure describing a maximum gap d1, which is the distance between the outer diameter surface of the cam 101 and any one corner of the polygonal structure of the sieve 105 and a minimum gap d2, is the distance between the outer diameter surface of the cam 101 and center of one side of the polygonal structure of the sieve 105. FIG. 1A shows an exploded section of a polishing chamber 100, of FIG. 1, indicating the maximum gap d1 and minimum gap d2.

Figure 2:
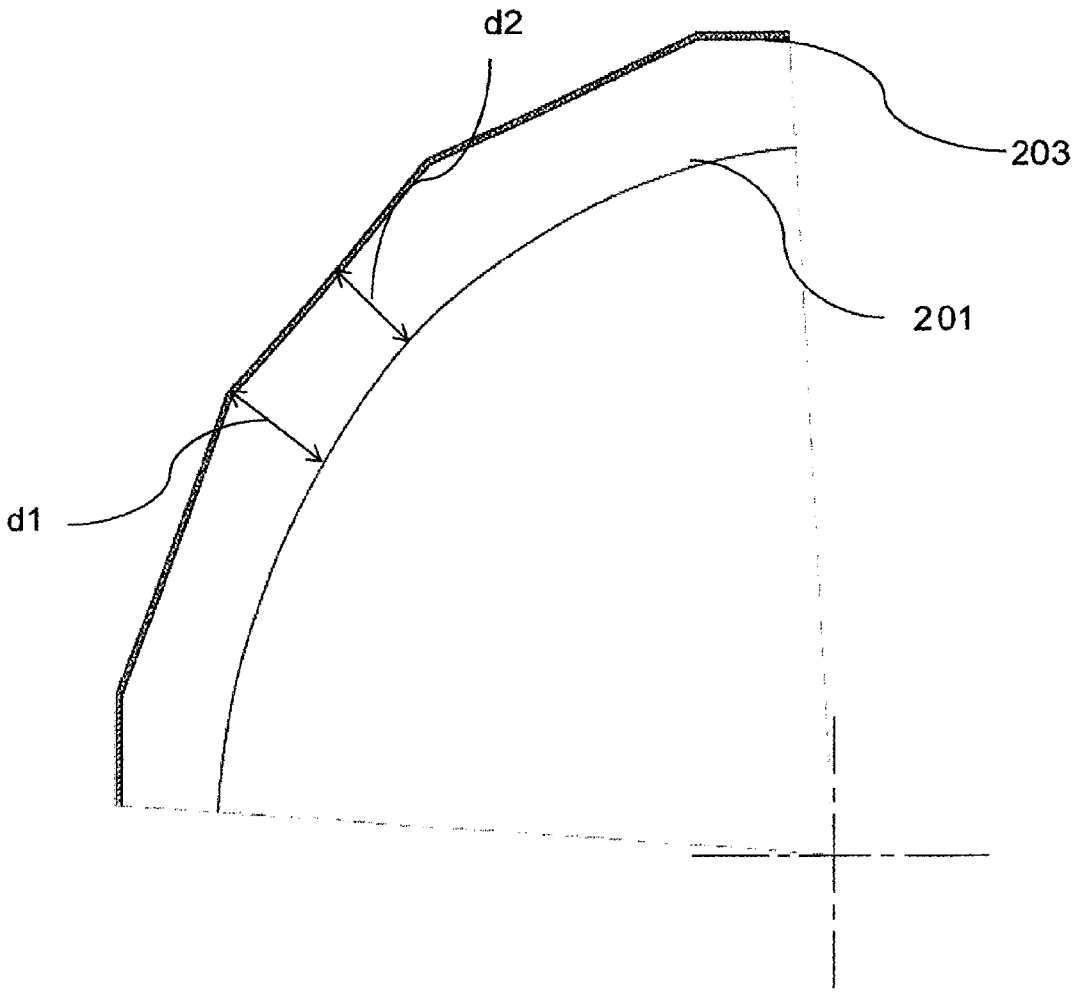
FIGS. 2 and 2A shows an exploded section of a polishing chamber for a machine of increased capacity indicating constructions that provides the maximum and minimum gaps required for polishing, according to the example of the invention.

FIG. 2 shows an exploded section of a polishing chamber for a machine of increased capacity indicating the maximum gap d1 and minimum gap d2 required for effective polishing, according to one example of the invention. It is essential to maintain a definite ratio of maximum gap d1 to minimum gap d2. FIG. 2 A shows an exploded section of a polishing chamber for a machine of increased capacity indicating the construction that provides the required ratio of the maximum gap d1 to the minimum gap d2, required for effective polishing, according to the example of the invention.

FIGS. 1 and 1A, generally illustrates the polishing chamber 100 with the cam 101 and sieve 105 arrangement. The sieve 105 is configured to form a polygonal structure that describes a maximum gap d1 and minimum gap d2. The maximum gap d1 is 29.83 mm and the minimum gap d2 is 22.00 mm. Hence the ratio of d1 to d2 is 1.36. The preferred ratio for providing effective polishing is the range of 1.2 to 1.5, irrespective of the capacity of the polishing machine.

Therefore the ratio of 1.36 as indicated herein above is an acceptable ratio for providing effective polishing.

Figure 2A:
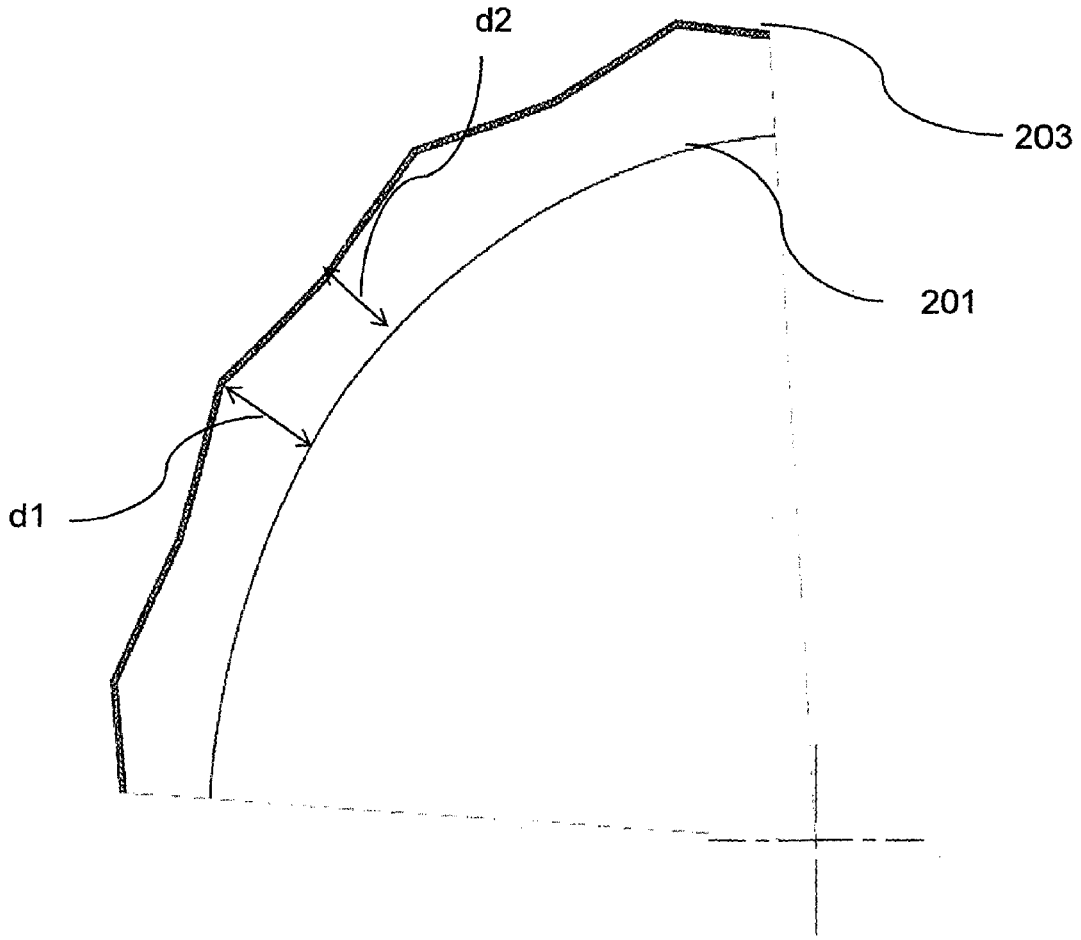

FIGS. 2 and 2 A generally illustrates the polishing chamber with cam and sieve arrangement for a polishing machine of higher capacity. FIG. 2 shows an exploded section of a polishing chamber for a machine of increased capacity wherein the maximum gap d1 is 29.83 mm and minimum gap d2 is 25.95 mm giving the ratio of d1 to d2 as 1.15. The ratio is outside the preferred range of 1.2 to 1.5 and hence not desirable for performing effective polishing. FIG. 2A particularly illustrates a reconfiguration of the sieve, wherein the internal bend is provided in the region which describes the minimum gap. The internal bends are angled and thus form concave corners of the polygonal structure. By reconfiguring the sieve arrangement with the internal bends, the number of corners of the polygonal structure is, in this case, doubled. The internal bend created reduces the minimum gap d2 to 22.00 mm and restores the ratio of d1/d2 to the value of 1.36, which is the preferred ratio for ensuring effective polishing of the rice grains within the annulus formed in the polishing chamber.

Further embodiments of the invention and detailed description of the invention shall be provided in the complete specification to follow.

We claim:

1. A rice polishing machine with an elongate, tubular shaped sieve arrangement with a polygonal profile, comprising a cylindrical shaped cam co-axially arranged within the sieve arrangement such that between an inner surface of the sieve arrangement and a jacket-surface of the cam a polishing chamber has a maximal and a minimal radial distance between jacket-surface of the cam and the inner surface of the sieve arrangement, wherein the sieve having an internal bend provided between each corner of the polygonal profile, the internal bend provided in a region of the minimal radial distance, wherein a number of convex corners of the polygonal profile of the sieve is larger than 8, and wherein each corner of the polygonal profile is a convex corner and each internal bend is a concave corner.

2. The rice polishing machine according to claim 1, where a ratio between the maximal and the minimal radial distance is between 1.2 and 1.5, independent of an absolute value of a radius of the cam.

3. The rice polishing machine according to claim 1, wherein the number of corners of the polygonal profile is even.

4. The rice polishing machine according to claim 1, wherein each convex corner of the polygonal profile is neighboured by two concave corners such that an alternating sequence of convex and concave corners is formed.

5. The rice polishing machine according to claim 1, wherein the minimal radial distance is in a range of 13 to 25 mm.

6. A sieve arrangement, in particular for the rice polishing machine according to claim 1, having an elongate, tubular shape with a polygonal profile.

7. The sieve arrangement according to claim 6, wherein the sides of the polygonal profile between the corners are straight.

8. The sieve arrangement according to claim 6, where the sides of the polygonal profile are curved, in particular concavely curved.

9. The rice polishing machine according to claim 2, wherein the ratio between the maximal and minimal radial distance is between 1.3 and 1.4.

10. The rice polishing machine according to claim 9, wherein the ratio between the maximal and minimal radial distance is around 1.35.

11. The rice polishing machine according to claim 1, wherein the minimal radial distance is in a range of 17 to 23 mm.

12. The rice polishing machine according to claim 1, wherein the minimal radial distance is around 22 mm.

* * * * *